US006502595B2

(12) United States Patent
Louie

(10) Patent No.: US 6,502,595 B2
(45) Date of Patent: Jan. 7, 2003

(54) TRANSFIGURABLE SELF-ERECTING STRUCTURE

(75) Inventor: Wai Hang Louie, Hunghom (HK)

(73) Assignee: Carillon International Limited (HK)

( * ) Notice: Subject to any disclaimer, the term of this patent is extended or adjusted under 35 U.S.C. 154(b) by 0 days.

(21) Appl. No.: 09/790,404

(22) Filed: Feb. 21, 2001

(65) Prior Publication Data

US 2002/0112753 A1 Aug. 22, 2002

(51) Int. Cl.[7] ..... E04H 15/40
(52) U.S. Cl. ..... 135/125
(58) Field of Search ..... 135/125–128, 135/97; 52/63, 222

(56) References Cited

U.S. PATENT DOCUMENTS

| | | | | |
|---|---|---|---|---|
| 3,960,161 A | | 6/1976 | Norman | |
| 4,858,635 A | | 8/1989 | Eppenbach | |
| 4,951,333 A | | 8/1990 | Kaiser et al. | |
| 5,031,652 A | | 7/1991 | Lester | |
| 5,038,812 A | | 8/1991 | Norman | |
| 5,560,385 A | | 10/1996 | Zheng | |
| 6,220,265 B1 | * | 4/2001 | Zheng | 135/125 |
| 6,305,396 B1 | * | 10/2001 | Zheng | 135/126 |
| 6,328,050 B1 | * | 12/2001 | McConnell | 135/137 |

* cited by examiner

*Primary Examiner*—Janet M. Wilkens
(74) *Attorney, Agent, or Firm*—Henri J. A. Charmasson; John D. Buchaca

(57) ABSTRACT

A self-erecting structure includes a series of fabric panels each tautly spread by a length of steel wire or other resiliently flexible, filiform material. The steel wire may form a closed loop, an open loop or a mere arc. The wire is selectively inserted into at least two of several pockets or fabric straps positioned around the periphery of the panel. The selection of the wire-holding pockets or straps defines the shape of the spread-out panel. Parts of the fabric which are not encompassed by a wire are held folded over it and against the spread-out portion. The shape of the structure can be quickly modified by repositioning of the wires.

11 Claims, 3 Drawing Sheets

TRANSFIGURABLE SELF-ERECTING STRUCTURE

FIELD OF THE INVENTION

This invention relates to temporary structures made of canvas stretched over foldable wire armatures such as tents, sun shades and a variety of toys.

BACKGROUND OF THE INVENTION

The prior art contains a great number and variety of self-erecting, collapsible and portable structures made by the juxtaposition of panels of many shapes and dimensions where each panel is formed by a sheet of fabric stretched by a loop of steel wire or similar resiliently flexible filiform elements. Examples of this type of structure are disclosed in U.S. Pat. Nos. 3,960,161 Norman and 5,038,812 Norman, which patents are incorporated in this specification by his reference. In every instance, the wire loop is permanently attached to the periphery of the panel. While such fixedly defined panels can be joined in a variety of ways in order to change the shape, size or even nature of the structure, there is a definite advantage in providing ever improved versatility so that the same device can be put to variety of uses.

SUMMARY OF THE INVENTION

The principal and secondary objects of this invention are to provide wire and fabric structural panels whose shapes and dimensions can be quickly modified in order to provide structures that can be transfigured into others of different shapes, sizes and uses.

These and other valuable objects are achieved by using steel wire and fabric panels in which the wire is not confined to a fixed attachment to the fabric sheet, but, instead, is loosely inserted in a selection of several releasable pocket or recesses formed in various parts of the sheet's periphery. Judicious positioning of sizing of the recesses and pockets allow for the reconfiguration of a particular panel from one shape to another. Combinations of those transfigurable panels can lead to the construction of diverse structures out of the same components.

Figure 1:
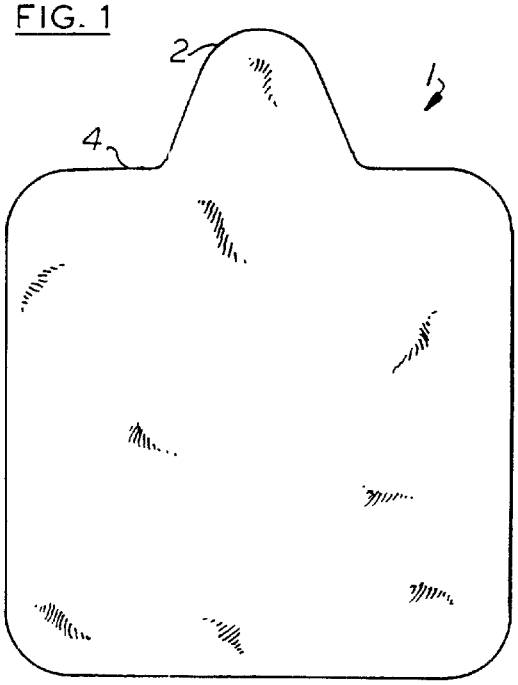
FIG. 1 is a front elevational view of a sheet of fabric used in forming an exemplary structural panel according to the invention.
Figure 2:
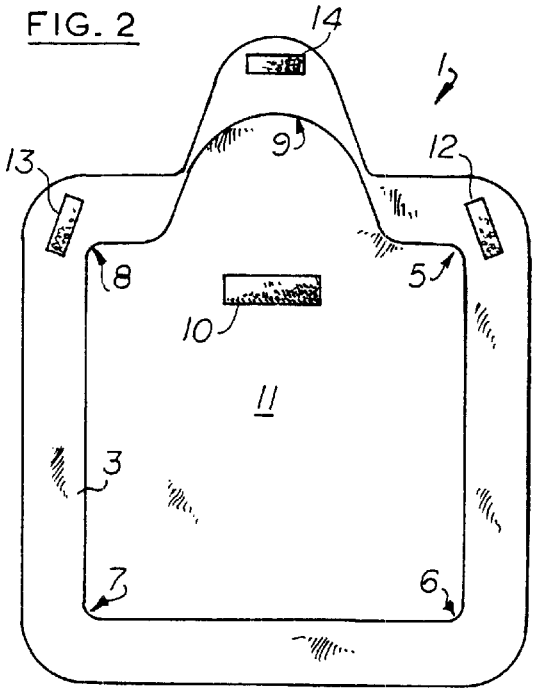
FIG. 2 is a back elevational view thereof.

Referring now to the drawing, there is shown in FIGS. 1 and 2 a sheet 1 of a fabric or other pliable material of a quadrangular configuration with a substantially triangular section 2 projecting from one of its sides. As more specifically shown in FIG. 2, a strip 3 of the same fabric material is applied to a marginal peripheral area of the sheet 1, and sewn or otherwise secured to it along its entire outer edge 4. Accordingly, a series of recesses or pockets 5–9 are formed at each corner of the sheet as well at the triangular section 2. A patch 10 of hook-and-vane, also called hook-and-loop fasteners, fabric fastener is secured in the inner, central area 11 of the sheet. Cooperating fastener patches 12–14 are applied to the left and right upper corners of the strip and to the triangular section 2.

Figure 3:
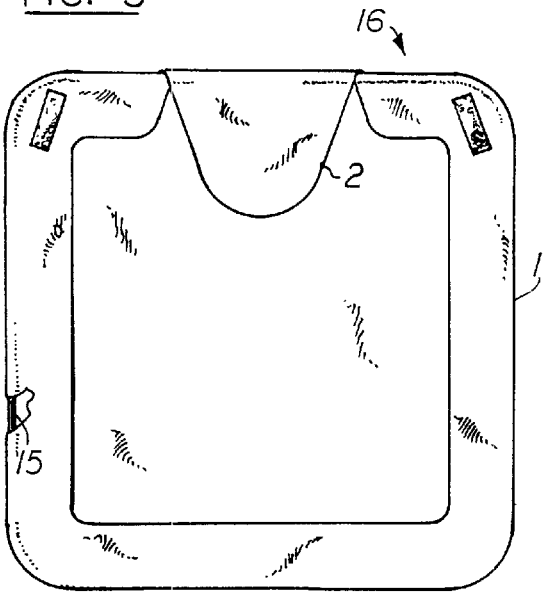
FIG. 3 is a back elevational view of a first version of a panel made from the sheet of FIGS. 1 and 2.
Figure 4:
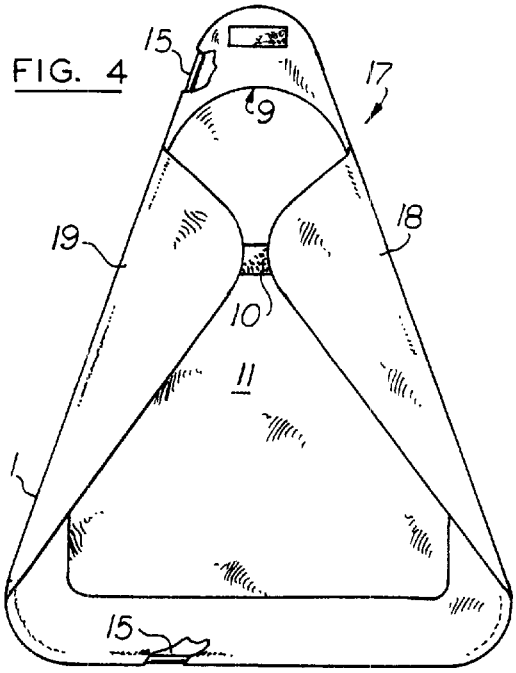
FIG. 4 is a back elevational view of a second version of the same panel.

As illustrated in FIGS. 3 and 4, the above-described sheet of fabric 1 is combined with a length or loop 15 of steel wire or other resiliently flexible filiform material such as plastic or wicker to create a transfigurable structural panel. The length of steel wire may comprise a closed loop as shown on the drawing, or may be constituted by an open loop or a mere arcuate wire section depending upon the shape of the desired structure.

In a first quadrangular version 16 of the panel, the loop is inserted into the four pockets 5–8 formed at the corners of the sheet 1. The triangular section 2 of the sheet is folded over the loop and against the inner central area 11, and retained thereupon by the cooperating patches 10 and 14 of fabric fasteners. It should be noted that the length or circumference of the loop, is substantially equal to the periphery of the quadrangular portion of the sheet of fabric 1.

This first version of the panel can be quickly and conveniently transfigured into the triangular version 17 illustrated in FIG. 4 by pulling the loop out of the upper corner pockets 5, 8 and inserting it into the central pocket 9 formed in the triangular section 2 of the sheet. The unspread parts 18, 19 of the sheet of fabric which are outside the triangle now defined by the loop are folded over and against the inner central portion of the sheet and secured thereupon by the cooperating upper corner fastener patches 12, 13 meeting the central patch 10. In both versions of the panel, the major portion of the sheet is spread tautly by the loop 15 to provide a versatile structural element of a variety of potential self-erecting structures as exemplified below.

It should be noted that the wire loop can be secured to various alternate portions of the sheet by means other than recesses and pockets such as strings, straps or loops strategically positioned at various locations.

Figure 5:
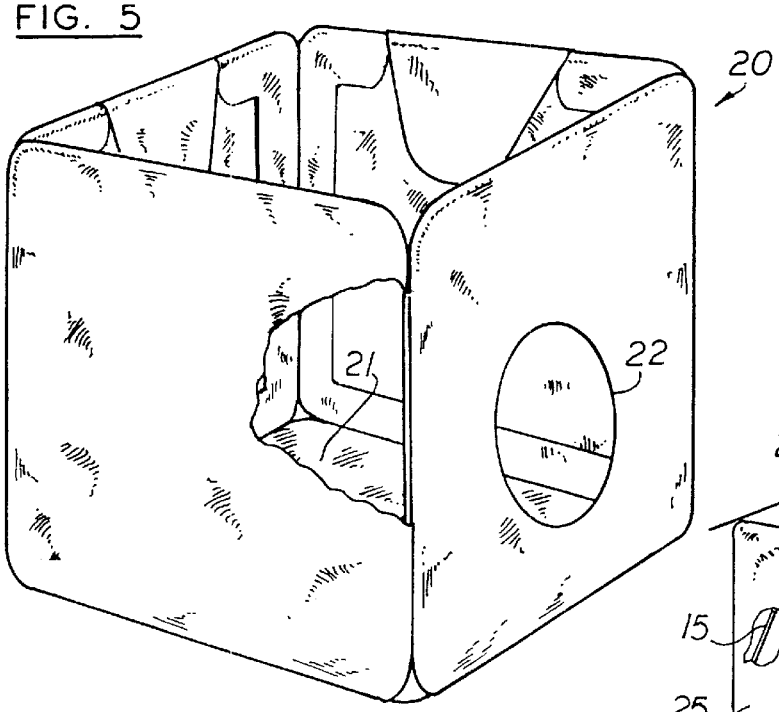
FIG. 5 is a cubic structure made from a juxtaposition of several of said panels.

The cubic structure 20 of FIG. 5 is made by tying together four of the quadrangular versions 16 of the panel wherein each panel is attached along its opposite lateral sides to two other panels. A quadrangular sheet of fabric 21 sewn around its periphery to the base of each of the four panels form a floor or ceiling for the structure depending upon its orientation. An aperture 22 cut into one of the panel provides for human access into the space enclosed by the panels.

Figure 6:
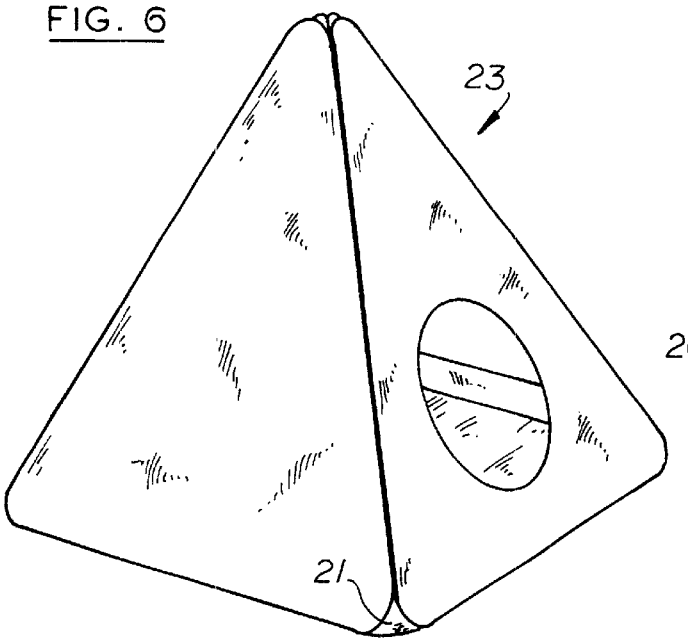
FIG. 6 is a pyramidal version of said structure.

The pyramidal structure 23 of FIG. 6 is a simple transfiguration of the cubic structure of FIG. 5. Each panel is modified to assume the triangular version 17 of FIG. 4. It should be noted that although the unspread sections of the fabric sheets are joined along their edges, this does not prevent their folding over and against the inner central area of two of the panels.

Figure 7:
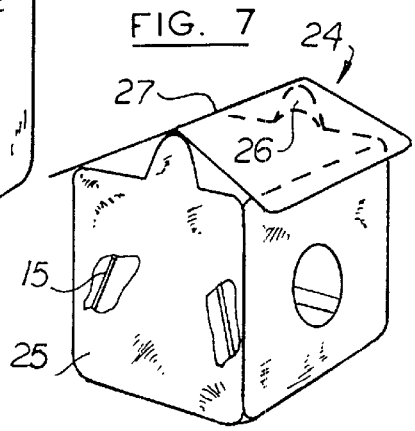
FIG. 7 is the first shelter structure based on the cubic version of FIG. 5.

The structure 24 of FIG. 7 is another transfiguration of the cubic structure of FIG. 5 in which only two opposite panels 25, 26 are put in the triangular configuration of FIG. 4. Their apexes support a roof panel 27.

Figure 8:
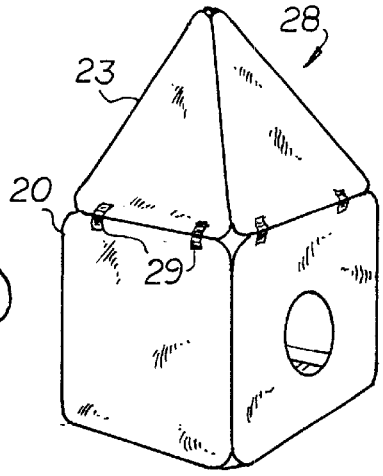
FIG. 8 is a second shelter structure combining the cubic and pyramidal configuration.

The structure 28 of FIG. 8 combines in a superimposed arrangement, the cubical structure of FIG. 5 and the pyramidal structure of FIG. 6, the latter without a floor panel. The two structures can be held together by means of straps 29 bearing patches of hook-and-vane fabric fasteners or other equivalent tying means.

Figure 9:
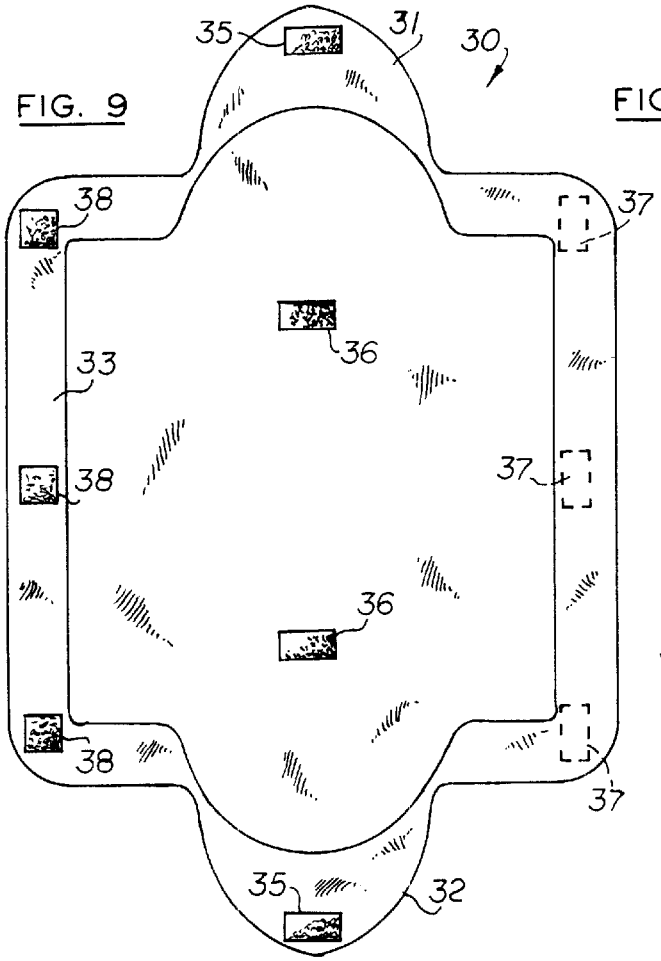
FIG. 9 is a back elevational view of an alternate sheet of panel fabric.

The second sheet of fabric 30 illustrated in FIG. 9 has two ogival sections 31, 32 projecting from median areas of opposite sides. A strip 33 similar to the one described in connection with the sheet of FIG. 1 forms recesses and pockets to receive a resiliently flexible wire loop 34 in at least the two different positions illustrated in FIGS. 10 and 11. Cooperating sets of hook-and-vane fabric fasteners 35, 36 and 37, 38 are provided so that the ogival section can be folded over and retained against the central area 39 of the sheet as shown in FIG. 10, and the unspread flaps 40, 41 which are outside the loop, the configuration of FIG. 11 can be folded upon each other.

Figure 11:
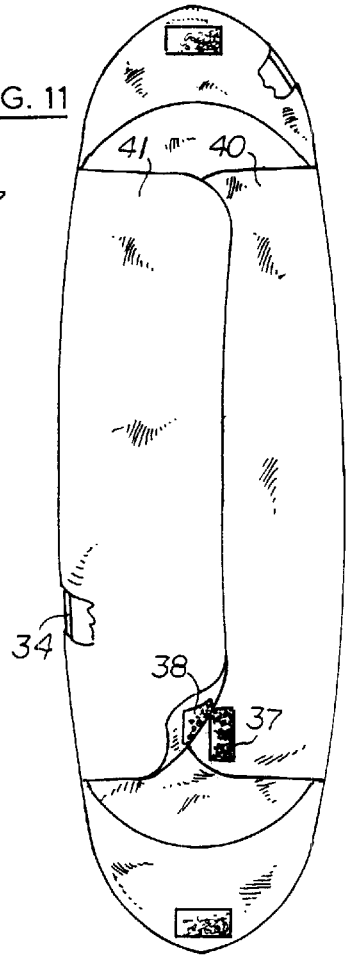
FIG. 11 is an ogival version thereof.
Figure 10:
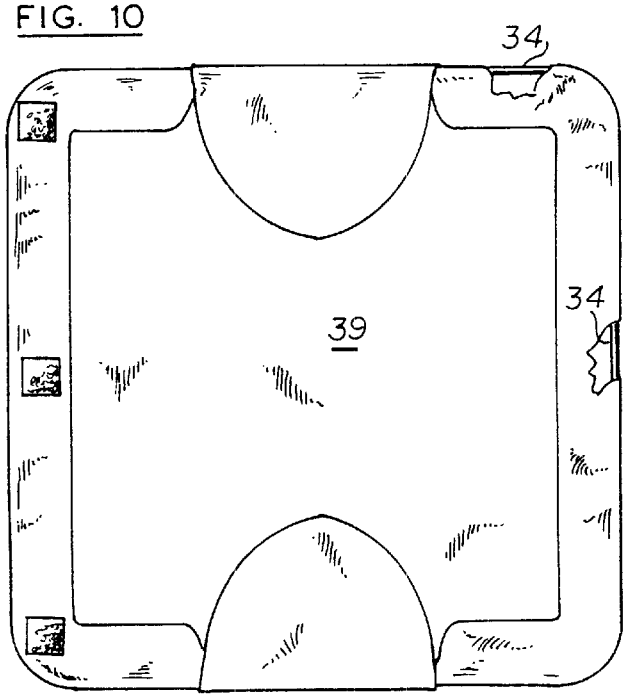
FIG. 10 is a quadrangular panel using said fabric.

The transfigurable structure or structural element of FIGS. 10 and 11 can be put to a variety of uses either singly as a trampoline, an activity mat, a beach mat, a picnic mat or a hammock, or in combination with similar or different elements to form various types of self-erecting and collapsible shelters.

While the preferred embodiments of the invention have been described, modifications can be made and other embodiments may be devised without departing from the spirit of the invention and the scope of the appended claims.

What is claimed is:

1. A self-deploying structure which comprises at least one panel configurable into a plurality of shapes, said panel including:

a sheet of fabric having a central area and a marginal, peripheral area;

a length of resiliently flexible, filiform material;

a plurality of releasable means, positioned about said peripheral area, for retaining said length of material; and said length of material being selectively insertable into at least two of said releasable means for retaining to tautly spread at least a portion of said sheet; and wherein at least one part of said sheet remains unspread by said length of material.

2. The structure of claim 1, wherein said panel further comprises means for holding said unspread part folded over said spread portion.

3. The structure of claim 1, wherein said means for retaining comprises at least one pocket formed in said peripheral area.

4. The structure of claim 3, which comprises at least three of said panels, each being connected at opposite sides to two other of said panels.

5. The structure of claim 4, wherein said connected panels define an enclosed space.

6. The structure of claim 5, wherein at least one of said panels has an aperture sized to provide access into said enclosed space.

7. The structure of claim 1, wherein said means for retaining comprise at least one section of said sheet releasably folded over said length of material.

8. The structure of claim 7, which comprises at least three of said panels, each being connected at opposite sides to two other of said panels.

9. The structure of claim 8, wherein said connected panels define an enclosed space.

10. The structure of claim 9, wherein at least one of said panels has an aperture sized to provide human access into said space.

11. The structure of claim 1, wherein said length of filiform material comprise a closed loop.

* * * * *